US006413013B1

(12) United States Patent
Requena

(10) Patent No.: US 6,413,013 B1
(45) Date of Patent: Jul. 2, 2002

(54) AUTONOMOUS STRIP LAYING DEVICE

(76) Inventor: Julien Requena, 6 rue des Carrieres, 25360 Nancray (FR)

( * ) Notice: Subject to any disclaimer, the term of this patent is extended or adjusted under 35 U.S.C. 154(b) by 0 days.

(21) Appl. No.: 09/622,344

(22) PCT Filed: Feb. 16, 1999

(86) PCT No.: PCT/FR99/00345

§ 371 (c)(1),
(2), (4) Date: Aug. 16, 2000

(87) PCT Pub. No.: WO99/41458

PCT Pub. Date: Aug. 19, 1999

(30) Foreign Application Priority Data

Feb. 16, 1998 (FR) ..... 98 02046

(51) Int. Cl.[7] ..... E01C 23/16; B32B 31/00; B26D 7/00

(52) U.S. Cl. ..... 404/94; 83/649; 156/355; 156/523

(58) Field of Search ..... 404/93, 94; 83/649; 156/355, 523, 574, 577; 222/22, 30, 43

(56) References Cited

U.S. PATENT DOCUMENTS

| | | | | | |
|---|---|---|---|---|---|
| 2,546,308 | A | * | 3/1951 | Kahler | 156/575 |
| 3,717,540 | A | * | 2/1973 | Henc | 156/577 |
| 3,886,011 | A | * | 5/1975 | Eigenmann | 156/71 |
| 3,964,559 | A | * | 6/1976 | Eigenmann | 180/1 AP |
| 3,964,835 | A | * | 6/1976 | Eigenmann | 404/94 |
| 4,030,958 | A | * | 6/1977 | Stenemann | 156/350 |
| 4,242,173 | A | * | 12/1980 | Stenemann | 156/523 |
| 4,313,780 | A | * | 2/1982 | Ford, Jr. | 156/523 |
| 4,317,696 | A | * | 3/1982 | Hutchinson et al. | 156/523 |
| 4,824,516 | A | * | 4/1989 | Ishihara et al. | 156/523 |
| 5,772,359 | A | * | 6/1998 | Marty | 404/94 |
| 5,800,668 | A | * | 9/1998 | Bumb | 156/577 |
| 5,865,943 | A | * | 2/1999 | Marty | 156/577 |

FOREIGN PATENT DOCUMENTS

| | | |
|---|---|---|
| FR | 2 674 874 | 10/1992 |
| FR | 2 705 982 | 12/1994 |
| FR | 2 723 753 | 2/1996 |

* cited by examiner

*Primary Examiner*—Gary S. Hartmann
(74) *Attorney, Agent, or Firm*—Young & Thompson

(57) ABSTRACT

An autonomous strip laying device for marking the ground includes a rolling frame supporting a reel of strip to be unwound, a strip unwinding assembly, elements for applying the strip on the ground including an applicator roll, a device for sectioning the strip and an assembly driving the frame and actuating the different devices and the unwinding elements. The assembly unwinding the strip and the elements for applying the strip are, at least during the unwinding and laying of the strip, mutually synchronized in rotation by synchronizing elements.

13 Claims, 4 Drawing Sheets

AUTONOMOUS STRIP LAYING DEVICE

CROSS REFERENCE TO RELATED APPLICATION

This is the 35 USC 371 national stage of International Application PCT/FR99/00345 filed on Feb. 16, 1999, which designated the United States of America.

1. Field of the Invention

The present invention relates to the field of marking the ground, in particular streets and parking spaces, by means of marking strips and has for its object an autonomous device for laying such strips.

2. Background of the Invention

At present, the horizontal marking of parking spaces, as well as the provisional marking of streets, particularly detours on streets undergoing work, are generally carried out by means of strips, which may be self-adhesive, applied with heat and pressure. Emplacement of the strips is generally carried out manually by first cutting them out, then applying them to the ground, if desired with heat, and supplemental pressure by means of heat and supplemental pressure by means of a suitable device. For the application of self-adhesive strips, a first stripping of protective film from their adhesive surface is necessary, partially complicated the work of laying them and involving a corresponding loss of time. Moreover, manual laying of these strips, which are relatively heavy, often requires at least two operators and is relatively difficult.

There has been proposed, in FR-A-2 674 874, an autonomous device for laying self-adhesive strips, constituted by a support frame for means for unrolling strips, by a roller for applying the strip to the ground, by a transfer device of the strip, from the unrolling means to the application roller, by means for stripping and recovering the protective film on the self-adhesive surface, by a device for sectioning the strip and by a drive assembly for the chassis and the different devices and the means for unrolling, stripping, recovery and sectioning the strip to be applied.

Moreover, French utility certificate 2 723 753 discloses an autonomous device for laying self-adhesive strips, in particular for marking the ground, characterized in that it comprises an articulated rolling frame, whose forward portion carries the roll of strip to be unrolled, the assembly for unrolling the strip, the sectioning device and the application means of the strip to the ground, such that the unrolling and application assembly can be oriented independently of the rear portion of the frame.

The marking of the ground with prefabricated strips is at present developing, both as to the adhesives and as to the structure of the strips themselves that are laid. The continuously improved performance of the adhesives now makes it possible to return to strips to which adhesive is directly applied, to the detriment of the self-adhesive strips which require more complicated machines, and hence are more costly and more difficult to use and maintain. The always-increasing requirement for speed of application and quality of marking require that machines available at present on the market are no longer suitable or even are completely obsolete.

SUMMARY OF THE INVENTION

The present invention has for its object the provision of an autonomous device for laying prefabricated strips, in particular for marking the ground, permitting much higher speeds of application and hence the great reduction of time during which the sections of the roadway under construction or renovation are blocked. By way of example, and without thereby imparting any limitation, a strip application device according to the present invention can reach up to 4 km/h for continuous strips, a speed heretofore never reached while unrolling and laying prefabricated strips. Moreover, reopening the traffic lane is possible as soon as the marking is completed and this whether the marking is temporary or permanent. Another advantage of the device of the present invention is that it at the same time produces a quality of marking (trueness) and an ease of application substantially greater than those of known machines.

The present invention has for its object an autonomous device for laying strips, in particular for marking the ground, constituted essentially by a rolling frame for supporting a spool of strip to be unrolled, said spool being mounted on a spool-carrying axle provided with at least one gripping means, with an assembly for unrolling the strip, by means for applying the band to the ground comprising an applicator roller, by a device for sectioning the strip and by a drive assembly for the frame and for actuating the different devices and unrolling means, characterized in that said assembly of unrolling the strip and said means for applying the strip are, at least at the time of unrolling and laying the strip, synchronized in rotation with each other by at least one synchronization means. The synchronization means used in the present invention consist of an arrangement of belts, pulleys and/or double pulleys and the like.

The assembly for unrolling the strip is constituted by a fixed axle, a feed roller, an upper traction drum coacting with at least one upper roll-carrying axle, a driver and separator, of which the rollers are in the form of rollers or pointed roller or with projecting portions, these points or projecting portions being in one piece or connected to and arranged in diamond fashion from one roller to the other with the intersection of their generatrices.

In a preferred embodiment, the device according to the invention moreover comprises means for straightening the strip, for example in the form of a straightening axle provided with a straightening roller. The straightening means is thus parallel to the unrolling assembly and provided with one or several guide means permitting adjusting straightening, the widths and the gripping of the strip. The adjustment of the straightening means is preferably carried out by means of the mentioned guide means, placing the gripping means of the spool-carrying axle. In particular, it can be provided that the adjustment of the guide means of the straightening means is carried out such that the strip will be slightly stretched over the straightening axle of the straightening means.

As to the sectioning of the strip to be adhered, this is carried out by a sectioning device permitting carrying out cuts on the fly.

A cut is called on the fly when it is made instantaneously without interrupting the movement of the strip to be cut.

The sectioning device of the present invention comprises a transverse blade made of quenched steel of well-defined hardness.

Said blade slides, during its cutting, between carrying guide slides while being actuated, at its end opposite the cutting end, by a sectioning jack. The sectioning jack can be a pneumatic jack controlled by an electrovalve with manual or automatic operation. The pneumatic jack is designed such that its power will be sufficiently high to cut all types of strips that exist or are to come. The forward and return path of the jack is preferably as small as possible. On the other hand, to be able to cut a wide and thick band or a thin and very flexible band, it is advantageous to be able to adjust the play existing between the blade and the counter-blade as well as the angles of grinding such that the cut will be clean and precise.

The presence of a straightening roller prevents the band from deviating to the left or right at the time of cutting. Thus, said roller keeps the band perfectly perpendicular to the plane of the cut, which gives perfectly square cuts.

As will be described later, the sectioning device comprises, in addition to the mentioned blade, a counter-blade, said blade being arranged perpendicularly to the plane of the strip between the unrolling assembly and the applicator means and coacts, for sectioning, with said counter-blade extending over a support parallel to said blade between the upper drum of the unrolling assembly and the applicator roller, so as to produce an instantaneous cut without stopping the machine.

This device for cutting on the fly permits obtaining speeds of application of the band that are much higher than those possible with apparatus of the prior art. As already mentioned, the blade and/or the counter-blade are of quenched steel, so as to ensure sufficient mechanical resistance to the cutting instruments as well as a high and constant quality cut.

The autonomous device for laying strips moreover comprises a control and display console for driving the apparatus. This console will be described in a more detailed manner later and has, in addition to the usual members permitting operating the apparatus, a programmable robot for controlling the laying of the strip. The device comprising a control and display console having a programmable robot for controlling the laying of the strip is characterized in that said console comprises a control member permitting selecting between three manners of carrying out the cutting, either manually, or semi-automatically, or automatically.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE INVENTION

Figure 1:
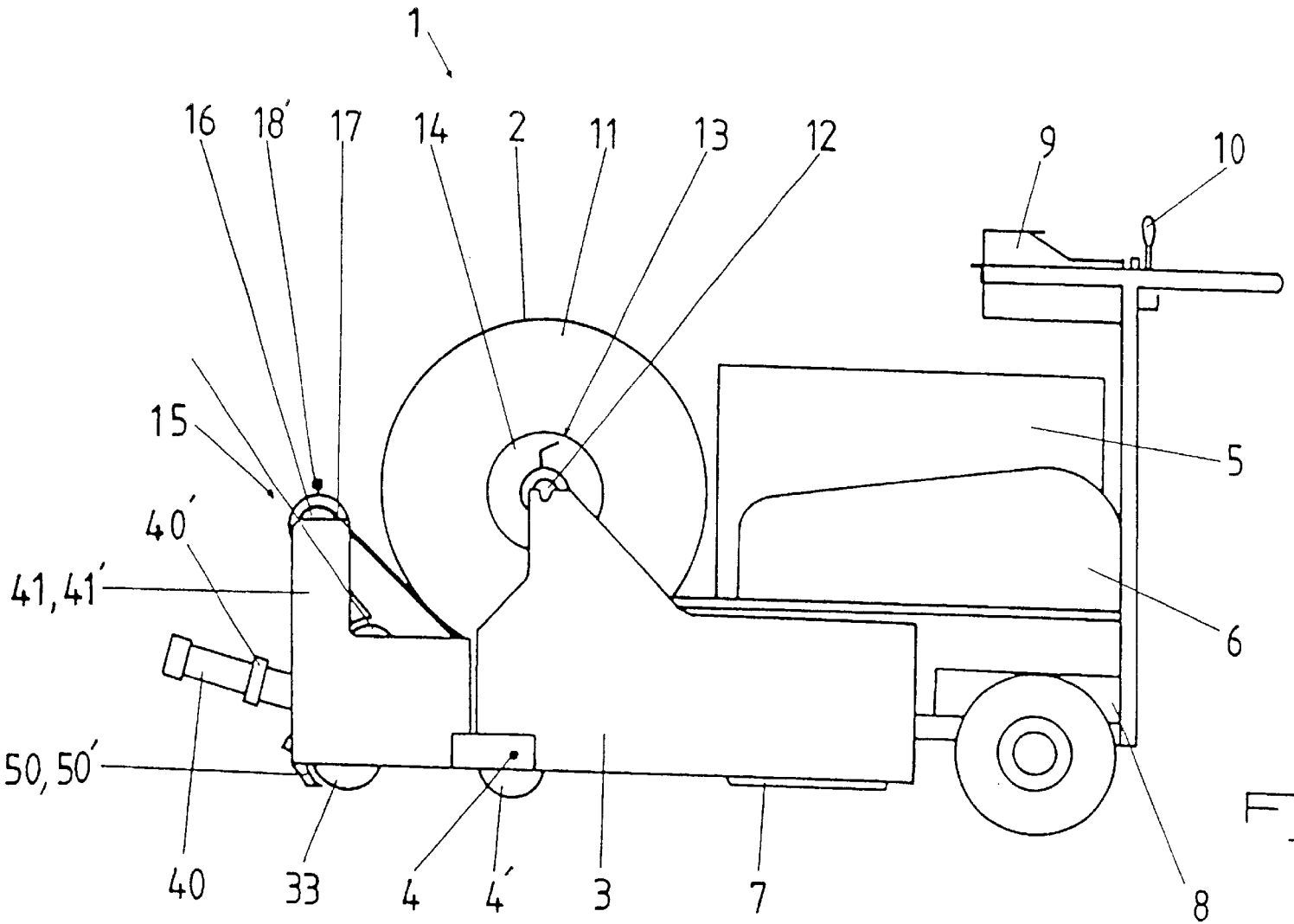
FIG. 1 is a side elevational and cross-sectional view of a device according to the invention.

According to the invention and as shown more particularly in FIG. 1 of the accompanying drawings, the autonomous device 1 for laying strips 2, in particular for marking the ground, is essentially constituted by a rolling frame 3, an assembly (not shown) for driving the frame and for actuating the different devices and unrolling means for the strip 2, by a pivoting axle 4 on a bearing roller 4' on the chassis, a motor 5, preferably a heat engine, a compressor 6 for supplying the pneumatic circuits, an air reserve 7, a hydrostatic bridge 8, a control and display console 9 provided with control members 10 and connected to a source of electrical energy such as a battery (not shown).

The traction portion of the autonomous device 1 for laying strips 2 can be embodied, as a function of the drive assembly, in several ways (self-supported, self-driven), the embodiment described hereafter, by way of non-limiting example, being a self-driven mode.

Figure 2:
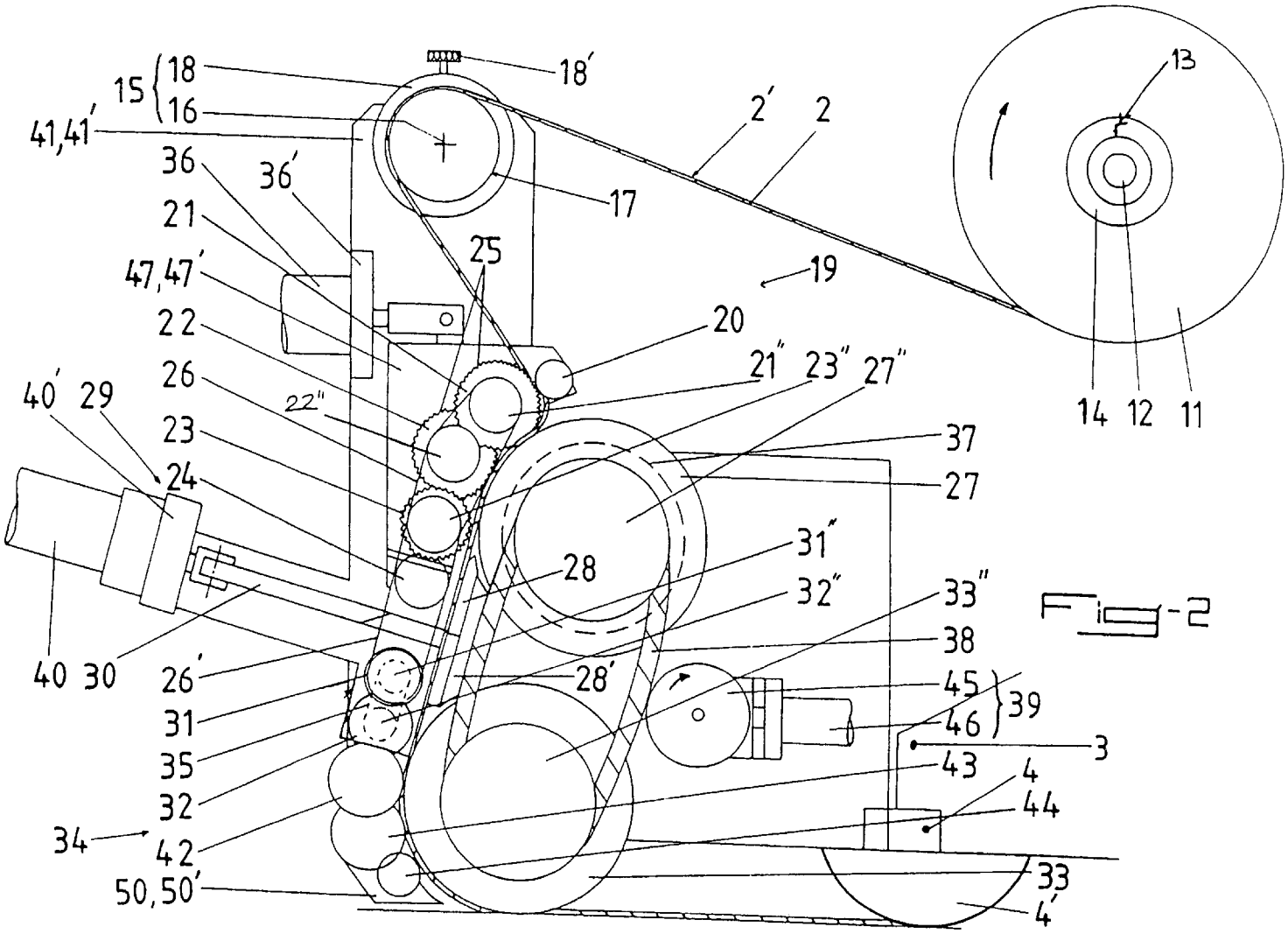
FIG. 2 is a fragmentary view on a larger scale, in side elevation and in cross-section, of the drive and the different means acting on the strip, from the storage spool to the application of the strip to the ground.

As shown in FIG. 2, the path traveled by the strip 2 runs from the spool 11 to its application to the ground at the level of the applicator roller 33. The spool 11 for storing the strip 2, mounted on a spool-carrying axle 12, is disposed on a special recess on the frame. The unrolling of the strip 2 can be adjusted as to position and as to the tension in the strip which runs on a bias from gripping means 13 provided in the form of flanks 14 or the like located on the spool-carrying axle 12.

Figure 3:
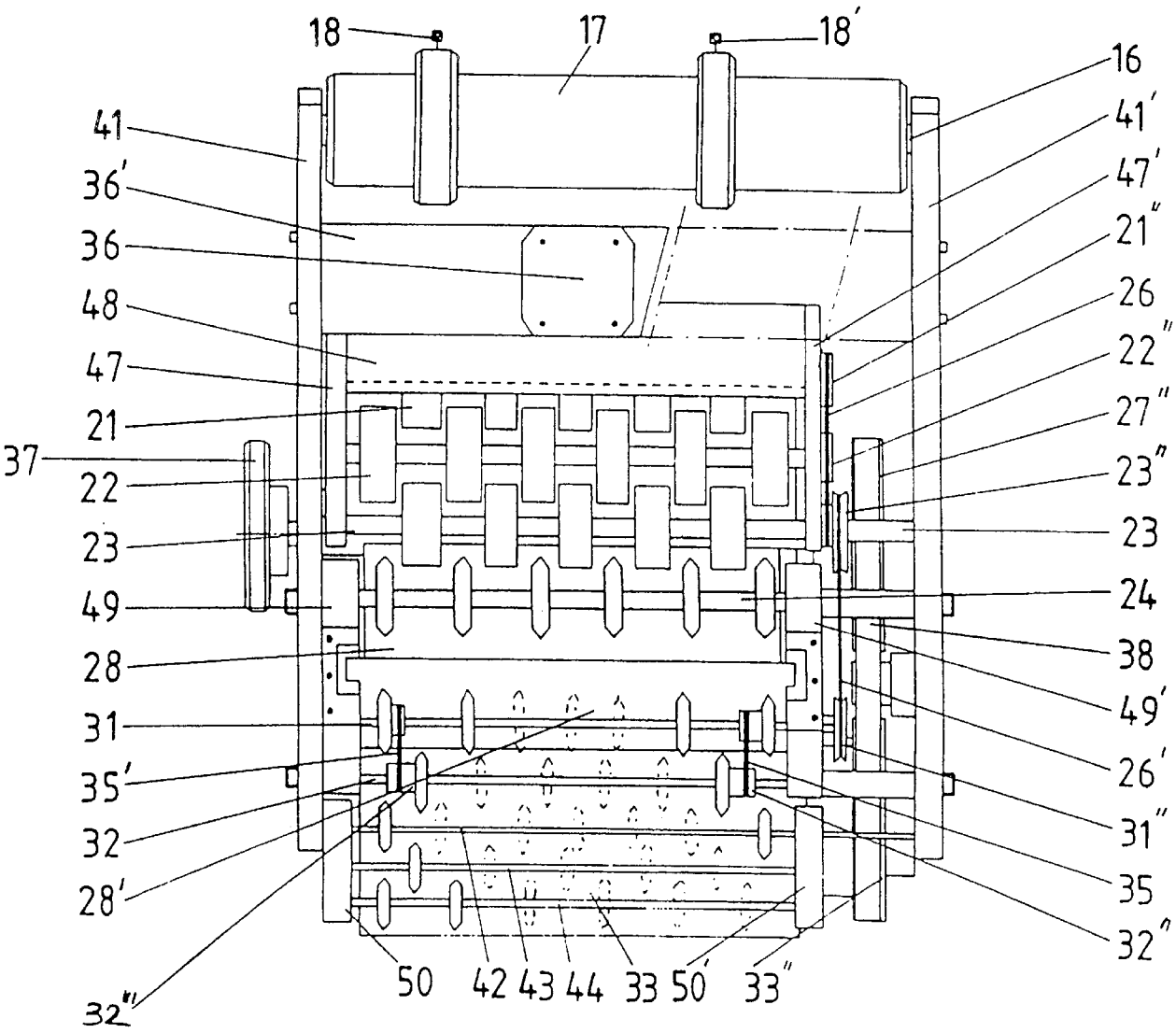
FIG. 3 is a front view on a larger scale of the different means of FIG. 2, acting on the strip from the storage spool to its application to the ground.

The strip 2 is drawn, with the adhesive portion 2' upward, in the unrolling direction indicated by the arrow, in the direction of the straightening means 15 constituted by a straightening axle 16 provided with a straightening roller 17 located just in front of the unrolling assembly 19. As shown in FIG. 3, this straightening axle 16 is mounted in a perfectly parallel manner to the unrolling assembly 19 between the flanks 41 and 41' interconnected by a crosspiece 36', the rotation of the strip 2 about the axle preventing the deterioration of this latter by avoiding as much as possible friction at the moment of travel. The straightening roller 17 is provided with one and preferably several guide means 18 such as rings, plates or the like which adjust and maintain the straightening, the width and the position of the band 2. Of course, the adjustment of these guide means 18 must take place over the same alignment as the flanks 14 of the gripping means 13 of the spool-carrying axle 12. The guide means 18 of the straightening roller 17 can be fixed by conventional blocking means 18' such as for example bolts or knurled screws or the like.

It is also possible to provide several spools 11 of strip 2 on the spool carrier 12, for example, to carry out the marking of a street in the form of two parallel lines. It is then possible to add pairs of supplemental flanks 14 on the spool-carrying axle 12 as well as pairs of supplemental guides on the straightening axle 16. There can thus be caused to unroll simultaneously two or several rolls of strip and obtain a perfectly parallel marking.

Moreover, a symmetrical positioning of the spools 11 on the spool-carrying axle 12 will also permit carrying out a symmetrical marking, for example relative to the center line of the street.

Upon leaving the storage spool 11, the strip 2 will be guided and straightened by the straightening axle 16, just before being introduced into the unrolling assembly 19 for the strip 2 which is particularly comprised by a supply roller 20 of, for example, natural rubber or polyurethane, from a series of upper roller-carrying axles 21, 22, 23 and from a fixed axle 24 (FIGS. 2 and 3). At this point, the strip is pinched between the first upper roller-carrying axle 21 and the small supply roller 20 mounted in contact with the pointed rollers on this first axle. The combination of the straightening rollers 17 with continuous pinching between the upper roller-bearing axle 21 and the supply roller 20 guarantees that the strip 2 cannot swing laterally, neither to the left nor to the right. These means associated with the spool-carrying axle 12, also fixed on the frame, and the flanks 14, which are adjustable, particularly in width, and which will grip the sides of the storage spool 11, permit holding the strip 2 always slightly stretched over the straightening axle 16, the flanks 14 on the sides of the spool preventing the latter from continuing to turn at the moment of cutting, under the influence of inertia.

Figure 4:
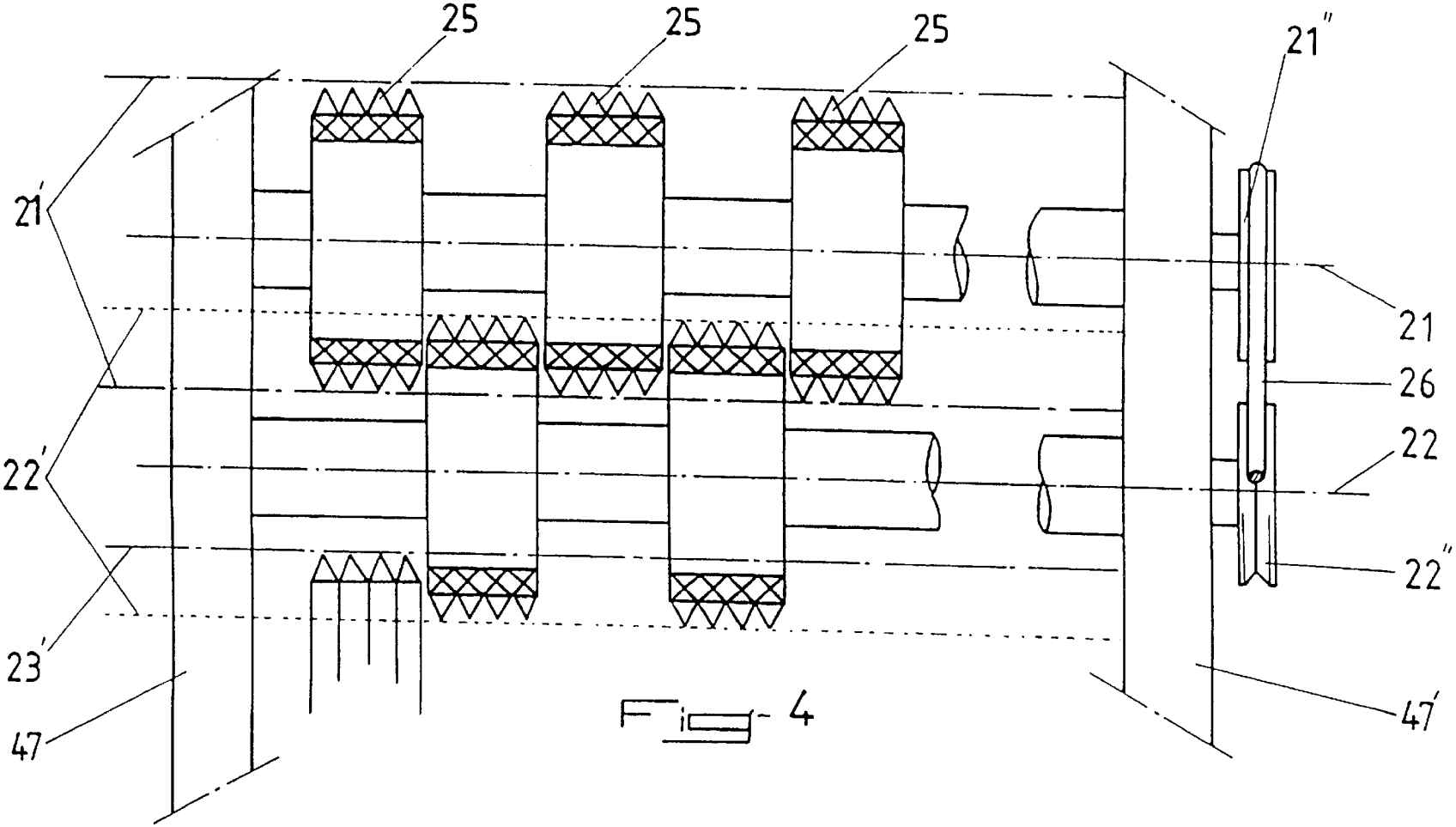
FIG. 4 is a fragmentary plan view, on a larger scale, of the rollers mounted on the upper roller-bearing axles of FIG. 2.

As shown particularly in FIGS. 2 and 4, the rollers of the upper roller-bearing axles 21, 22 and 23, the drives and separators, are preferably in the form of pointed rollers or have projecting portions 25, these points or projecting portions 25, made of one piece with or connected thereto, can be sharp or slightly rounded. FIG. 4 shows that the rollers of the upper roller-bearing axles 21, 22, 23 are disposed in a diagonal fashion from one roller to the other and with the intersection of their generatrices 21', 22', 23' and that they are fixed in rotation with each other by means of synchronization means here in the form of pulleys 21", 22", the double pulley 23" and the upper flexible belt 26. The axle 23 also drives, by the bias of the double pulley 23", of the pulley 31' and of the lower flexible belt 26', the lower roller-bearing axle 31, which in its turn drives the lower roller-bearing axle 32 by means of pulleys 32", 32"' and lateral belts 35 and 35'. It is thus possible to provide a perfect drive for the strip 2.

So as to avoid any risk of the strip 2 jamming, particularly when it is cut, and in particular for products such as aluminized strips, the lower roller-bearing axles 31, 32 are located just below the blade 30, and are moreover made in a manner similar to the upper roller-bearing axles 21, 22, 23, and hence are also synchronized in rotation with the unrolling assembly 19 located above the blade 30 by synchronization means similar to those used for synchronizing the upper roller-bearing axles 21, 22, 23, namely, pulleys 31", 32", 32"', the flexible belts 26, 26', and side belts 35, 35'. A belt 26' synchronizes particularly the upper roller-bearing axle or axles 21, 22, 23 with the lower roller-bearing axle or axles 31, 32, the rollers of one or more of the lower roller-bearing axles 31, 32 being able to drive the forward or frontal end of the new portion of the strip to be cut, which avoids jamming (FIG. 3).

The supply width of the strip 2 has been optimized so as to have a surface, and hence a greater number of points or of projecting portions 25 of the rollers, thereby permitting reducing the pressure exerted on the strip 2. This considerably increases the flexibility of unrolling, given the fact that all the axles which carry rollers are synchronized in rotation, except the fixed axle 24 and the guide axles 42, 43, 44 which are not driven. The rollers of the different roller-bearing axles are preferably mounted in alternating fashion and are in turn drivers and separators, when the strip passes over the pointed rollers or projecting portions 25. The synchronization also permits decreasing the pressure applied to the upper jack 36. The ease of advance of this autonomous device 1 for laying strips 2 is increased by the presence of a supplemental hydrostatic bridge 8 connected to a motor 5 for its movement, said motor 5 being also adapted to drive a compressor 6 adapted to supply air under pressure for supplying the different actuating members, for example, of the type of jacks 36, 40. In contrast to a transmission whose ratios are constant, the hydrostatic bridge 8 permits advance of the autonomous device 1 for laying strips 2 with a flexibility of advance controlled at all times.

During emplacement of the strip 2 in the unrolling assembly 19, the end of the strip 2 is introduced between the points or projecting portions 25 of the rollers of the first upper roller-carrying axle 21 and the supply roller 20, these two elements being mounted to press against each other. The user of the machine then actuates the control member or members 10 from the control and display console 9 which correspond to bringing the upper jack 36 against the upper drive drum 27. The upper roller-carrying axles 21, 22, 23 being in contact with said upper drum 27, it then suffices for the user to turn manually, by means of the knurled member 37, the upper drum 27, in the desired direction to advance or retract the strip 2 and thus to position it. The strip 2 is then driven by the rollers of the upper roller-carrying axle 21 and upon arriving at the following upper roller-carrying axle 22, the latter repeats the operation until the strip 2 is located at the level of the counter-blade 28 of the sectioning device 29. The strip 2 will thus be emplaced below the upper roller-carrying axle 23 where the fixed axle 24 is located whose rollers are freely mounted and idle, said fixed axle being mounted secured to the sectioning device 29 between the carrying slides 49 and 49' for the blade 30 (FIG. 3).

From the console 9, the operator starts the positioning of the strip 2 by an electric button actuating the robot: the applicator roller 33 which is located in contact with the ground, and hence the movement in rotation is synchronized with the movement of the machine, synchronizes in rotation the upper drum 27 by the bias of the belt 38 and the pulleys 27" and 33", the belt 38 being free and unstressed at rest. The assembly of the tensioning roller-jack 39 will stretch, at the moment of beginning laying, the belt 38, and thus gives rise to the synchronized rotation of the upper drum 27 and of the applicator roller 33 and in the same way the movement of the strip 2.

The operator then activates, by means of control members 10 from the display and control console 9, the programmable robot for controlling the laying of the strip 2, permitting selecting between three manners of carrying out the cut, either manually, or semi-automatically, or automatically. In the manual mode, the operator carries out the cut from the console 9; in the semi-manual mode, the following laying takes place only under the order of the operator, the cut being carried by an electronic control, and in the automatic mode, the electronic control repeats a cycle of measuring the length of strip 2, of the space desired to be left between two consecutive sections of strip 2, and of the triggering of the cut.

As is seen in FIGS. 2 and 3, the sectioning device 29 of the autonomous device 1 for laying strips 2 is constituted by a transverse blade 30 guided between the slide carriers 49 and 49' and actuated at its end opposite to the cutting end by a sectioning jack 40 mounted on a crosspiece 40', said blade 30 being disposed perpendicularly to the plane of the strip 2 between the unrolling assembly 19 and the laying means 34 and coacts, for sectioning, with said counter-blade 28 extending over a support 28' parallel to the blade 30 between the upper drum 27 and the unrolling assembly 19 and the applicator roller 33, so as to produce an instantaneous cut without stopping the machine. Moreover, this cut must be carried out in a fairly rapid manner, such that the nibbling effect will not cause the strip 2 to slide between the blade 30 and the counter-blade 28, which would have the result that the strip 2 would not be cut. A satisfactory cutting speed during movement of the strip 2 is obtained by the wise choice of the power of the sectioning jack 40, optimizing its supply of compressed air from the compressor 6 and thanks to the reserve 7 of air, by the bias of electro-distributors controlled from the control and display console 9.

By way of example, the compressed air pressure is comprised between 6 and 8 bars. Of course, the sectioning jack 40 as well as the other jacks employed in the present invention can also be actuated hydraulically or the like. So as to guarantee a high quality and constant cut, the blade 30 and/or the counter-blade 28 is/are preferably made of quenched steel, the blade 30 being moved by the sectioning jack 40.

It will also be noted in FIGS. 2 and 3 that the supply roller, the fixed axle 24 and the upper roller-bearing axles 21, 22, 23 are mounted on a pivoting frame, comprised between two flanks 47, 47' connected by a crosspiece 48.

Said pivoting frame is articulated about the upper roller-bearing axle 23 and positioned by an upper jack 36, the application of the rollers of said upper roller-bearing axles 21, 22, 23 to the strip 2, against the upper traction drum 27 and the counter-blade 28, being adjustable by means of the control and display console 9. The flanks 47 and 47' maintain all these members perfectly parallel to each other in a compact arrangement also called "laying head" which is delimited by the sidewalls 41 and 41' and which is connected to the rolling frame 3 by pivots oscillating about the axle 23. In this way, the laying head can oscillate (pivot) about said axle 23, this latter passing through the assembly from side to side and being disposed in roller bearings mounted on the sidewalls 41, 41' while being positioned by the upper jack 36 fixed on the cross-member 36', itself fixed on said sidewalls 41, 41' by conventional means known to those in the art. This mounting has the advantage, when the strip 2 passes below the applicator roller 33, of permitting the laying head to carry out a slight upward oscillation, the rest of the machine remaining perfectly stable, which ensures perfectly straight laying of the strip 2 on the ground.

As is seen very clearly in FIGS. 2 and 3, the strip 3 passes, during its advancement, between the blade 30 and the counter-blade 28 and below the lower roller-bearing axles 31 and 32 which are driven in rotation by the pulley 31" mounted on the lower roller-bearing axle 31 and interconnected by lateral belts 35, 35', the axle 31 being driven in its turn by upper and lower flexible belts 26, 26' moved by the upper roller-bearing axles 21, 22, 23. The rollers (not all shown) on the two lower roller-bearing axles 31 and 32 are also mounted alternatingly between themselves, the mentioned axles being mounted on sealed roller bearings as are preferably all the rotating axles of the present invention. The strip 2 continues its travel and arrives at the application means 34 for the strip 2 on the ground, essentially constituted by at least one lower roller-bearing axle 31, 32, at least one guide axle 42, 43, 44 and a roller applicator 33 which can be a second drive drum. The guide axle or axles 42, 43 and 44 are fixedly mounted in front of the applicator roller 33, seen in the direction of movement, between lateral support members 50 and 50' and having rollers (not all shown) which rotate freely and idly between circlips (not shown). Passing below the axle 44, the strip 2 touches the ground and the autonomous laying device 1, upon advancing, causes the applicator roller 33 to stick the end of the strip 2 which passes below it. Thus the strip 2, supplied by the unrolling assembly 19, is perfectly guided and applied to the ground.

The application means 34 for the strip 2 is in driving connection with the unrolling assembly 19 by means of a belt 38 mounted between pulleys 27" and 33" provided respectively on the upper traction drum 27 and the shaft of the applicator roller 33, the tensioning roller-jack assembly 39 playing the role of a coupling by stretching the belt 38 in service. The tension roller-jack assembly 39 can be constituted, as shown in FIG. 2 of the accompanying drawings, by a roller 35 mounted at the end of the piston rod 46 of a control jack or else by one of the pulleys 27" and 33" in the form of a pulley whose diameter is variable under the action of a jack, a cam or the like. Moreover, it will be noted that all the jacks are controlled by electro-distributors controlled by the automation of the control and display console 9. In a particular embodiment, a device according to the invention is characterized in that the upper drum 27, the applicator roller 33 (lower drum), the upper roller-bearing axles 21, 22, 23 and lower roller-bearing axles 31, 32, the drive and the separators, are mounted on ball bearings and are at least at the time of unrolling and laying, synchronized in rotation with each other by means of synchronization means 21", 22", 23", 26, 26', 27", 31", 32", 32'", 33", 35, 35', 38.

The device according to the invention operates in the following manner: after insertion of the beginning of the strip 2 in the unrolling assembly 19, and connection of the electrical circuits of the control and display console 9 by unlocking a main switch (not shown) the operator starts the working cycle by throwing in the forward gear and by actuating the clutch comprised by the tensioning roller-jack assembly 39 for driving the unrolling assembly 19. The upper roller-bearing axle or axles 21, 22, 23 and lower roller-bearing axle or axles 31, 32, as well as the fixed axle 24 and the guide axle or axles 42, 43, 44 as well as the laying means 34, thus permit a guided movement of the strip 2 toward the blade 30. Before the blade 30 cuts, the mentioned clutch is unclutched to avoid advance of the strip 2 during the time of cutting. After the return to the rest position of the transverse blade 30, the mentioned clutch is again brought into engaged position with the unrolling assembly 19 of the strip 2. This latter is thus driven by the lower roller-bearing axle or axles 31, 32 and guided by the applicator roller 33 and the axle or axles 41, 42, 43 to the ground.

It is of course also possible to carry out a continuous laying of the strip 2. Finally, after disconnecting the electrical control means by actuation of a main safety switch, the operator can move the device 1 without unrolling and laying the strip 2. Thanks to the invention, it is possible to provide an autonomous device 1 for laying strips, permitting rapid and high quality laying of said strips 2, without force or constraint up to the applicator roller 33, and without risk of damaging strips during laying.

Of course the invention is not limited to the embodiment described and shown in the accompanying drawings. Modifications remain possible, particularly as to the constitution of the various elements or by substitution of technical equivalents, without thereby departing from the scope of protection of the invention.

What is claimed is:

1. An autonomous device for laying at least one strip for marking a ground, which comprises:

a rolling frame for supporting a reel of strip to be unrolled;

an unrolling assembly including unrolling means for unrolling the strip;

application means including an applicator roller for applying the strip on the ground;

a sectioning device for sectioning the strip;

a drive assembly for the frame and for actuating different devices and the unrolling means; and at least one synchronization means for synchronizing in rotation said unrolling assembly and said application means with each other, at least at the time of unrolling and laying the strip; a sectioning of the strip taking place with the unrolling assembly and the application means being unsynchronized;

said unrolling assembly comprising a fixed axle, a supply roller, an upper traction drum coacting with at least one upper roller-carrying axle, a driver and separator having rollers with projecting portions made of one piece or connected and disposed in alternation from one roller to another with their generatrices intersecting.

2. The device according to claim 1, further comprising a tensioning roller-jack assembly to tension or untension a belt connecting said unrolling assembly and said application means; the desynchronization between the unrolling assembly and said application means taking place by unclutching, at the same time as cutting.

3. The device according to claim 1, wherein the application means comprises at least one lower roller-carrying axle and at least one guide axle.

4. The device according to claim 1, wherein the synchronization means comprise an arrangement of belts, of pulleys, or double pulleys; a belt synchronizing said at least one upper roller-carrying axle with said at least one lower roller-carrying axle.

5. The device according to claim 1, further comprising straightening means for straightening the strip.

6. The device according to claim 5, wherein the straightening means comprise a straightening axle provided with a straightening roller.

7. The device according to claim 5, wherein the straightening means comprise at least one guide means for adjusting the straightening, the width and the maintenance of the strip.

8. The device according to claim 5, further comprising a spool mounted on a spool-carrying axle provided with at least one gripping means, and guide means facing said gripping means for adjusting the straightening means.

9. The device according to claim 1, wherein the sectioning device comprises a transverse blade guided between carrier slides and actuated at its end opposite to a cutting portion by a sectioning jack, and a counter-blade; said transverse blade being disposed perpendicularly to the plane of the strip between the unrolling assembly and the application means, and coacting, for sectioning, with said counter-blade extending over a support parallel to said transverse blade between the upper traction drum of the unrolling assembly and the applicator roller to produce an instantaneous cut.

10. The device according to claim 9, wherein the transverse blade and the counter-blade are of quenched steel.

11. The device according to claim 9, further comprising a control and display console having a programmable robot for controlling the laying of the strip, and for adjusting the application of the rollers of said at least one upper roller-carrying axle to the strip, against the upper traction drum and the counter-blade; said console comprising a control member permitting selecting between three ways of carrying out the cut, namely: manually, semi-automatically, or automatically.

12. The device according to claim 1, wherein the supply roller, the fixed axle and said at least one upper roller-carrying axle are mounted on a pivoting frame, comprised between two flanks, articulated about the upper roller-carrying axle and positioned by an upper jack.

13. The device according to claim 1, further comprising a hydraulic bridge connected to a motor for its movement, said motor being also adapted to drive a compressor to supply air under pressure to different actuating members.

* * * * *